US008763425B2

(12) United States Patent
Sugitani

(10) Patent No.: US 8,763,425 B2
(45) Date of Patent: Jul. 1, 2014

(54) TURBO COMPRESSOR WITH MULTIPLE STAGES OF COMPRESSION DEVICES

(75) Inventor: Noriyasu Sugitani, Yokohama (JP)

(73) Assignee: IHI Corporation (JP)

( * ) Notice: Subject to any disclaimer, the term of this patent is extended or adjusted under 35 U.S.C. 154(b) by 1497 days.

(21) Appl. No.: 12/365,389

(22) Filed: Feb. 4, 2009

(65) Prior Publication Data

US 2009/0193841 A1 Aug. 6, 2009

(30) Foreign Application Priority Data

Feb. 6, 2008 (JP) ..... P2008-027069

(51) Int. Cl.

| | |
|---|---|
| ***F25B 1/10*** | (2006.01) |
| ***F04D 17/12*** | (2006.01) |
| ***F04D 29/063*** | (2006.01) |
| *F25B 1/053* | (2006.01) |

(52) U.S. Cl.

CPC ..... *F04D 17/122* (2013.01); *F25B 2400/13* (2013.01); *F04D 29/063* (2013.01); *F25B 1/10* (2013.01); *F25B 1/053* (2013.01)

USPC ..... 62/510

(58) Field of Classification Search

USPC ..... 62/510, 619

See application file for complete search history.

(56) References Cited

U.S. PATENT DOCUMENTS

| | | | | |
|---|---|---|---|---|
| 4,977,745 | A * | 12/1990 | Heichberger | 62/619 |
| 6,045,343 | A * | 4/2000 | Liou | 418/91 |
| 6,827,104 | B2 * | 12/2004 | McFarland | 137/624.13 |
| 6,920,759 | B2 * | 7/2005 | Wakana et al. | 60/726 |
| 7,093,528 | B2 * | 8/2006 | McFarland | 418/138 |
| 7,114,507 | B2 * | 10/2006 | Kuechler et al. | |
| 7,165,951 | B2 * | 1/2007 | Magami et al. | 417/396 |
| 8,096,117 | B2 * | 1/2012 | Ingersoll et al. | 60/408 |
| 8,316,927 | B2 * | 11/2012 | Kohara et al. | 165/272 |
| 8,327,634 | B2 * | 12/2012 | Orihashi et al. | 60/320 |
| 8,424,776 | B2 * | 4/2013 | Veettil et al. | 237/12.3 A |
| 8,601,832 | B2 * | 12/2013 | Tsukamoto | 62/510 |
| 2002/0121089 | A1 * | 9/2002 | Filippone | 60/608 |
| 2003/0074895 | A1 * | 4/2003 | McFarland | 60/395 |
| 2005/0013716 | A1 * | 1/2005 | Magami et al. | 417/555.1 |
| 2007/0147984 | A1 | 6/2007 | Takahashi et al. | 415/100 |
| 2013/0037235 | A1 * | 2/2013 | Sakabe et al. | 165/41 |

FOREIGN PATENT DOCUMENTS

| | | |
|---|---|---|
| JP | 58-37995 | 3/1983 |
| JP | 63-82093 | 5/1988 |
| JP | 63-201400 | 8/1988 |
| JP | 2-118192 | 9/1990 |
| JP | 2007-177695 | 7/2007 |

OTHER PUBLICATIONS

Office Action dated Nov. 6, 2012 issued in corresponding Japanese Patent Application No. 2008-027069 with English translation (4 pages).

* cited by examiner

*Primary Examiner* — Ljiljana Ciric

(74) *Attorney, Agent, or Firm* — Ostrolenk Faber LLP

(57) ABSTRACT

A turbo compressor includes: multiple stages of compression devices arranged in series with respect to a gas passage, each of the compression devices including an impeller that rotates about an axis; an oil tank capable of supplying lubricating oil to a sliding portion of the compression devices; a partitioned intermediate space formed to communicate with the gas passage on an upstream side of the compression devices via gaps between the partitioned intermediate space and the gas passage; and a pressure equalizer provided to continuously connect the partitioned intermediate space and the oil tank.

3 Claims, 3 Drawing Sheets

TURBO COMPRESSOR WITH MULTIPLE STAGES OF COMPRESSION DEVICES

BACKGROUND OF THE INVENTION

1. Field of the Invention

The present invention relates to a turbo compressor capable of compressing fluids using a plurality of impellers, and a refrigerator equipped with the turbo compressor.

Priority is claimed on Japanese Patent Application No. 2008-027069, filed Feb. 6, 2008, the content of which is incorporated herein by reference.

2. Description of the Related Art

As a refrigerator that cools or refrigerates an object to be cooled such as water, a turbo refrigerator or the like is known which is equipped with a turbo compressor that compresses and discharges a refrigerant by a compression device provided with an impeller or the like.

In the compressor, a higher compression ratio leads to a higher discharge temperature and a lower volumetric efficiency of the compressor. Accordingly, in the turbo compressor as mentioned above which is installed in the turbo refrigerator or the like, it is necessary, in some cases, to conduct the refrigerant compression through multiple stages. For example, in Japanese Unexamined Patent Application, First Publication No. 2007-177695, a turbo compressor is disclosed which has two compression stages, each of which is equipped with an impeller and a diffuser, and compresses a refrigerant sequentially through these compression stages.

In addition, in such a turbo compressor, an oil tank is provided which stores a lubricating oil to be supplied to the sliding portion in the compression device. In this oil tank, in order to recover the lubricating oil supplied to the sliding portion, it is necessary to create a pressure gradient so that the internal pressure is lower than that of the space where the sliding portion is located.

Accordingly, in the conventional turbo compressors, the pressure inside the oil tank has been made negative to recover the lubricating oil by directly connecting the oil tank and a suction port of the compression device via a piping (a pressure equalizer) so that the pressure inside the oil tank equals to that of the suction port, which has the lowest pressure in the compression device.

Meanwhile, the conventional turbo compressors as described above have been associated with the following problems.

That is, when operating a compressor, the pressure inside the oil tank reduces rapidly as the gas in the compressor is suctioned, since the oil tank and the suction port of the compression device are directly connected via a pressure equalizer. As a result, the gases which have been dissolved in the lubricating oil such as a refrigerant gas vaporize, resulting in what is known as oil foaming. Due to this oil foaming, the mist of oil filling inside the oil tank flows into the suction port through the pressure equalizer. For this reason, the amount of lubricating oil reduces which results in an insufficient supply of the lubricating oil to the sliding portion, and also the mist of oil mixes with the gas suctioned in by the compressor which results in the deterioration of compression properties.

The present invention is made in view of the above circumstances and its object is to provide a turbo compressor and a refrigerator which enable the recovery of lubricating oil by making the pressure inside the oil tank negative, while preventing the reduction of lubricating oil and the deterioration of compression properties.

SUMMARY OF THE INVENTION

In order to solve the aforementioned problems, the following configurations have been proposed in the present invention.

That is, a turbo compressor according to the present invention is characterized by conducting a compression process sequentially by suctioning the gas in the passage, and having multiple stages of compression devices arranged in series with respect to a gas passage, each of the compression devices includes an impeller that rotates about the axis; an oil tank capable of supplying lubricating oil to a sliding portion of the compression devices; partitioned intermediate space formed so as to communicate with the passage in the upstream side of the compression devices via the gaps therebetween; and a pressure equalizer provided so as to continuously connect the intermediate space and the oil tank.

According to the turbo compressor characterized by such features, the passage in the upstream side of the compression devices, that is, the space with the lower pressure communicates with the inside of the oil tank through the gaps therebetween, the intermediate space, and the pressure equalizer. By making the pressure inside the oil tank negative due to the above configurations, lubricating oil can be recovered.

Moreover, when the mist of oil reaches the intermediate space via the pressure equalizer, since the intermediate space and the passages on both sides of the compression devices are connected only through the slight gaps therebetween, the oil mist can be retained in the intermediate space, as a result of which the contamination of the compression devices by the oil mist can be prevented.

In addition, the turbo compressor according to the present invention is characterized in that the intermediate space has an annular shape having the axis as its center, and an open end of the pressure equalizer in the intermediate space is directed towards the tangential direction of the annular intermediate space.

Due to the above configuration, the oil mist reaching the intermediate space via the pressure equalizer is discharged towards the tangential direction of the annular intermediate space, and the swirling flow in line with the annular shape can be generated inside the intermediate space. Therefore, the oil mist can be retained in the outer periphery of the intermediate space due to the centrifugal force caused by this swirling flow, and thus it will be possible to reliably prevent the oil mist to leak out from the gaps to the passage.

Moreover, the turbo compressor according to the present invention is characterized in that a barrier plate is provided between the aforementioned gaps and the open end of the pressure equalizer in the intermediate space.

Due to the above configuration, it is possible to prevent the oil mist, which is discharged from the pressure equalizer to the intermediate space, to reach the gaps and to leak out to the compression device side, even more reliably.

Furthermore, the turbo compressor according to the present invention is characterized in that a flow rate adjusting unit which adjusts the suction amount of the compression devices is provided in the passage in the upstream side of the compression devices, and a drive section of the flow rate adjusting unit is accommodated within the intermediate space.

Due to the above configuration, the drive section of the flow rate adjusting unit is driven in an atmosphere where the oil mist is present, and thus the longevity of the drive section can be extended.

A refrigerator according to the present invention is characterized by having a condenser which cools and liquefies a compressed refrigerant; an evaporator which vaporizes the liquefied refrigerant and cools an object to be cooled by extracting heat of vaporization from the object to be cooled; and a compressor which compresses the refrigerant vaporized by the evaporator and supplies the refrigerant to the condenser; the compressor being a turbo compressor with any one of the above configurations.

According to the refrigerator having such features, the same results/effects as those achieved by the abovementioned turbo compressor can be attained.

According to the turbo compressor and refrigerator of the present invention, by providing the intermediate space between the passage in the upstream side of the compression devices and the oil tank, the oil mist can be retained in the intermediate space. As a result, it will be possible to prevent the deterioration of compression properties due to the contamination of the compression devices by the oil mist, and to supply sufficient amount of lubricating oil to the sliding portion by suppressing the reduction of lubricating oil.

DETAILED DESCRIPTION OF THE INVENTION

Figure 1:
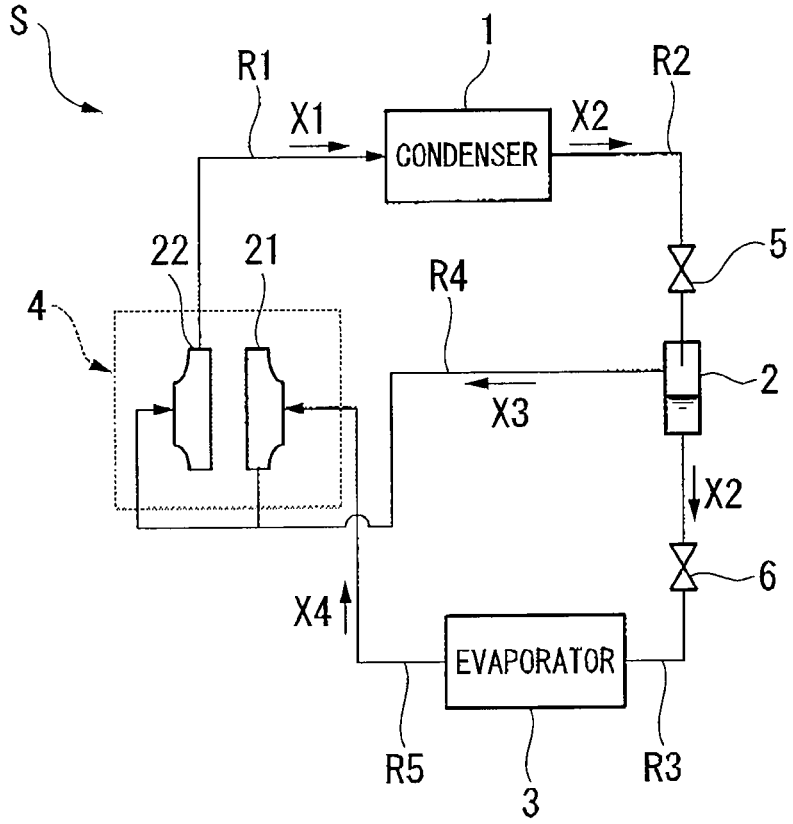
FIG. 1 is a block diagram showing a schematic configuration of a turbo refrigerator according to a first embodiment of the present invention.

One embodiment of a turbo compressor and refrigerator according to the present invention will be described below with reference to the accompanying drawings. It should be noted that the scale of each component in the drawings has been suitably altered in order to make each component a recognizable size.

FIG. 1 is a block diagram showing a schematic configuration of a turbo refrigerator S (a refrigerator) according to the present embodiment.

The turbo refrigerator S in the present embodiment is one to be installed, for example, in places like buildings and factories to produce cooling water for air conditioning, and includes a condenser 1, an economizer 2, an evaporator 3, and a turbo compressor 4, as shown in FIG. 1.

The condenser 1 is a device where a compressed refrigerant gas X1, which is a refrigerant (fluid) compressed in a gaseous state, is supplied, and a refrigerant liquid X2 is produced by cooling and liquefying the compressed refrigerant gas X1. As shown in FIG. 1, the condenser 1 is connected with the turbo compressor 4 via a passage R1 where the compressed refrigerant gas X1 flows through, and is also connected with the economizer 2 via a passage R2 where the refrigerant liquid X2 flows through. In addition, an expansion valve 5 for decompressing the refrigerant liquid 2 is disposed in the passage R2.

The economizer 2 temporarily stores the refrigerant liquid X2 decompressed at the expansion valve 5. The economizer 2 is connected with the evaporator 3 via a passage R3 where the refrigerant liquid X2 flows through, and is also connected with the turbo compressor 4 via a passage R4 where a gas phase component X3 of the refrigerant generated in the economizer 2 flows through. In addition, an expansion valve 6 for further decompressing the refrigerant liquid 2 is disposed in the passage R3. Moreover, the passage R4 is connected with the turbo compressor 4 so as to supply the gas phase component X3 to a second compression stage 22 described later, which is provided in the turbo compressor 4.

The evaporator 3 vaporizes the refrigerant liquid X2 and cools an object to be cooled, such as water, by extracting heat of vaporization from the object to be cooled. The evaporator 3 is connected with the turbo compressor 4 via a passage R5 where a refrigerant gas X4 generated by the vaporization of the refrigerant liquid 2 flows through. Note that the passage R5 is connected with a first compression stage 21 described later, which is provided in the turbo compressor 4.

The turbo compressor 4 compresses the refrigerant gas X4 to produce the abovementioned compressed refrigerant gas X1.

As described above, the turbo compressor 4 is connected with the condenser 1 via the passage R1 where the compressed refrigerant gas X1 flows through, and is also connected with the evaporator 3 via the passage R5 where the refrigerant gas X4 flows through.

In the turbo refrigerator S configured as described so far, the compressed refrigerant gas X1 supplied to the condenser 1 via the passage R1 is cooled and liquefied by the condenser 1 to produce the refrigerant liquid A2.

The refrigerant liquid X2 is decompressed by the expansion valve 5 when supplied to the economizer 2 via the passage R2, stored temporarily in the economizer 2 in a decompressed state, and then filter decompressed by the expansion valve 6 when supplied to the evaporator 3 via the passage R3.

Further, the refrigerant liquid X2 supplied to the evaporator 3 is vaporized by the evaporator 3 to produce the refrigerant gas X4, and the refrigerant gas X4 is then supplied to the turbo compressor 4 via the passage R5.

The refrigerant gas X4 supplied to the turbo compressor 4 is compressed by the turbo compressor 4 to produce the compressed refrigerant gas X1, and the compressed refrigerant gas X1 is again supplied to the condenser 1 via the passage R1.

Note that the gas phase component X3 of the refrigerant, which is generated when the refrigerant liquid X2 is stored in the economizer 2, is supplied to the turbo compressor 4 via the passage R4, and is then compressed together with the refrigerant gas X4. The compressed refrigerant gas X1 produced as a result of the compression is then supplied to the condenser 1 via the passage R1.

Additionally, in the turbo refrigerator S as described above, when vaporizing the refrigerant liquid X2 at the evaporator 3, an object to be cooled is cooled or refrigerated by extracting heat of vaporization from the object to be cooled.

Figure 2:
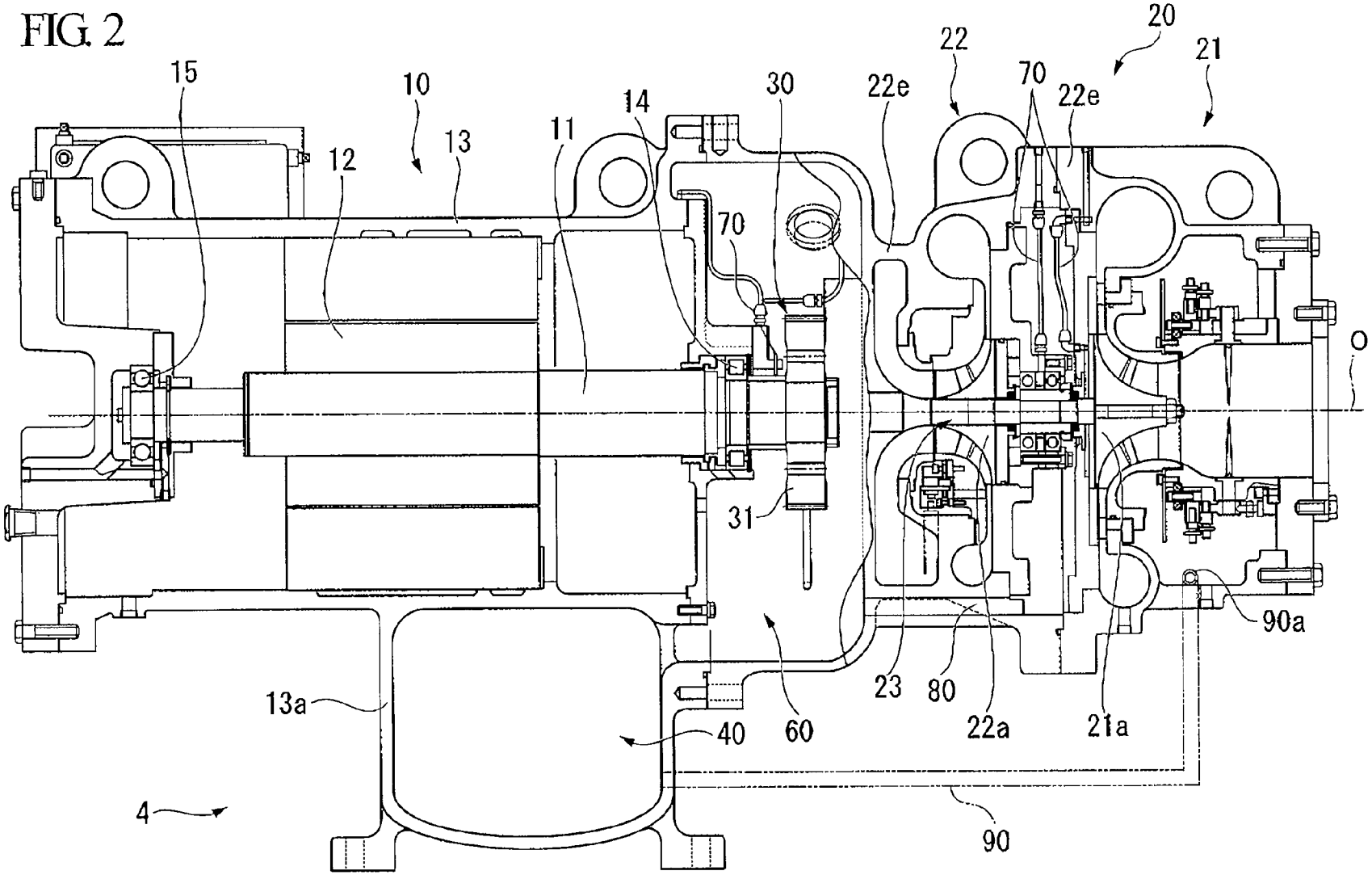
FIG. 2 is a vertical cross sectional view of a turbo compressor provided in the turbo refrigerator according to the first embodiment of the present invention.
Figure 3:
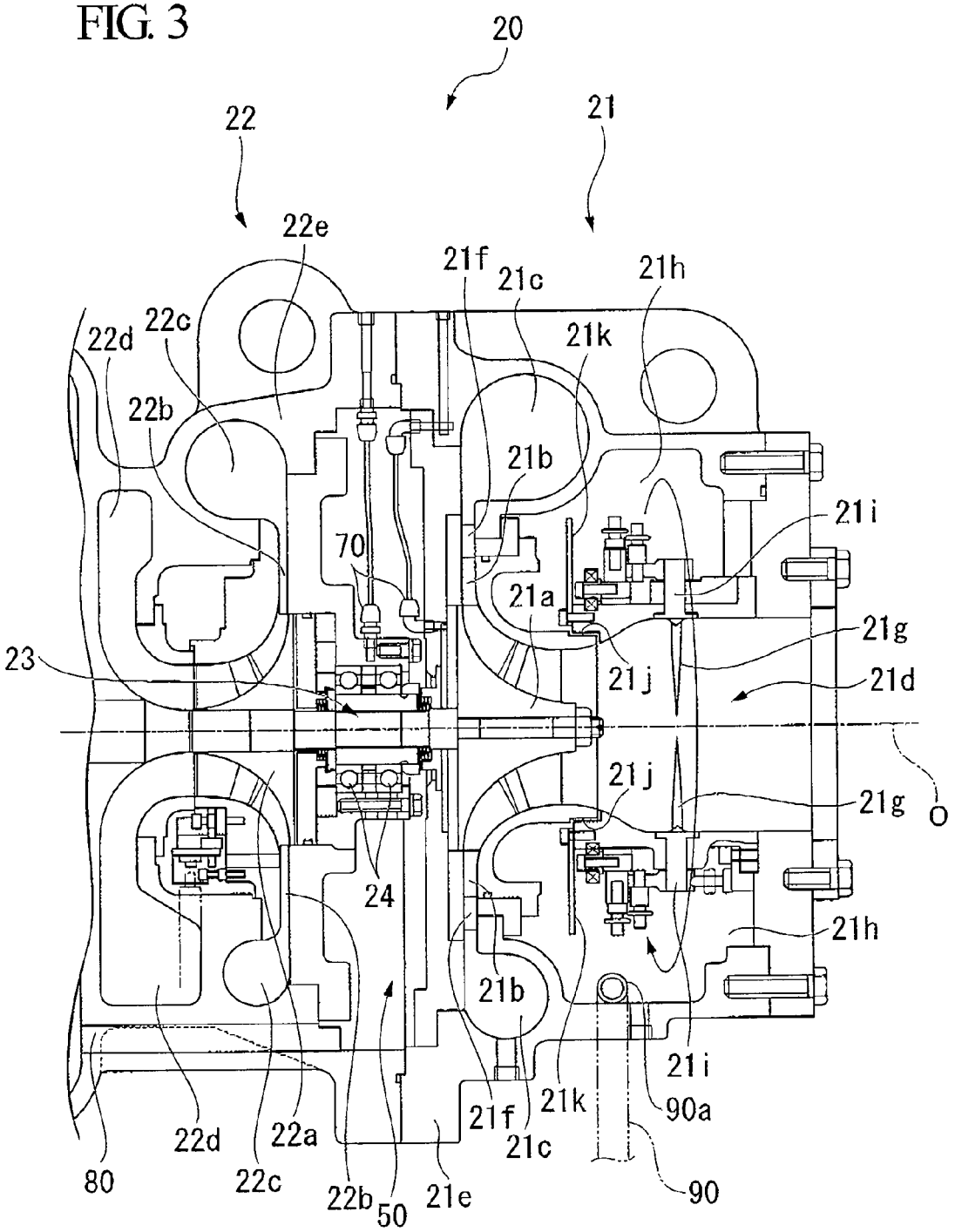
FIG. 3 is an enlarged view of FIG. 2 showing an essential part therein.

Next, the abovementioned turbo compressor 4 that most characterizes the present embodiment will be described in more detail. FIG. 2 is a vertical cross sectional view of the turbo compressor 4, and FIG. 3 is an enlarged vertical cross sectional view of a compressor unit 20 provided in the turbo compressor 4.

As shown in these drawings, the turbo compressor 4 in the present embodiment has a motor unit 10, a compressor unit 20, and a gear unit 30.

The motor unit 10 is provided with a motor 12 having an output shaft 11 that rotates about an axis O and acting as a driving source for driving the compressor unit 20; and a motor housing 13 which surrounds the motor 12 to support the motor 12.

It should be noted that the output shaft 11 of the motor 12 is rotatably supported by a first bearing 14 and second bearing 15 fixed to the motor housing 13.

In addition, the motor housing 13 includes a leg portion 13*a* supporting the turbo compressor 4.

The leg portion 13*a* is formed so that the inside thereof is hollow, and is used as an oil tank 40, where the recovered lubricating oil which has been supplied to the sliding portion of the turbo compressor 4 is stored.

The compressor unit 20 has, as shown in detail in FIG. 3, a first compression stage 21 (compression device) that suctions and compresses the refrigerant gas X4 (refer to FIG. 1); and a second compression stage 22 (compression device) that further compresses the refrigerant gas X4, which has already been compressed by the first compression stage 21, and discharges the resultant as the compressed refrigerant gas X1 (refer to FIG. 1).

The first compression stage 21 includes: a first impeller 21*a* (impeller) that imparts velocity energy to the refrigerant gas X4 supplied from the thrust direction and discharges the gas to the radial direction; a first diffuse 21*b* (diffuser) that compresses the refrigerant gas X4 by converting the velocity energy imparted to the refrigerant gas X4 by the first impeller 21*a* to pressure energy; a first scroll chamber 21*c* that guides the refrigerant gas X4 compressed by the first diffuser 21*b* to the outside of the first compression stage 21; and a suction port 21*d* that suctions the refrigerant gas X4 and then supplies the gas to the first impeller 21*a*.

Note that some parts of the first diffuser 21*b*, first scroll chamber 21*c* and suction port 21*d* are formed by a first housing 21*e* that surrounds the first impeller 21*a*.

The first impeller 21*a* is fixed to a rotating shaft 23 and is rotated about the axis O due to the rotation of the rotating shaft 23, which is imparted with the rotational power from the output shaft 11 of the motor 12.

The first diffuser 21*b* is disposed annularly in the periphery of the first impeller 21*a*. Additionally, in the turbo compressor 4 of the present embodiment, the first diffuser 21*b* is a diffuser attached with a plurality of diffuser vanes 21*f* which reduce the tangential velocity of the refrigerant gas 4 in the first diffuser 21*b* and efficiently convert velocity energy to pressure energy.

Further, in the suction port 21*d* of the first compression stage 21, a plurality of inlet guide vanes 21*g* for regulating the suction amount of the first compression stage 21 are disposed.

Each of the inlet guide vanes 21*g* is rotatably disposed so that the apparent area thereof as viewed from the flow direction of the refrigerant gas X4 is changeable by a drive mechanism 21*i*.

Additionally, in the outer periphery of the first impeller 21*a* and the suction port 21*d* located more upstream of the first impeller 21*a*, a partitioned annular intermediate space having the axis O as its center is formed by the first housing 21*e*. Inside the intermediate space 21*h*, the drive mechanism 21*i* for the inlet guide vanes 21*g* described above is installed.

In addition, the intermediate space 21*h* communicates with the suction port 21*d* via slight gaps 21*j*, as a result of which the pressure in the intermediate space 21*h* and that of the suction port 21*d* are always equal.

Moreover, as shown in FIGS. 2 and 3, the intermediate space 21*h* is connected with the abovementioned oil tank 40 through a pressure equalizer 90. The pressure equalizer 90 continuously connects the inside of the oil tank 40 with the intermediate space 21*h*. Due to the above configuration, the pressure inside the oil tank 40 always remains equal to that of the intermediate space 21*h*.

Also, an open end 90*a* of the pressure equalizer 90 in the intermediate space 21*h* is disposed so as to be directed towards the tangential direction of the annular intermediate space.

Furthermore, within the intermediate space 21*h*, a barrier plate 21*k* is provided extending from near the gaps 21*j* and projected to the outer radial direction of the axis O. Due to the above configuration, the gaps 21*j* and the open end of the pressure equalizer 90 are separated so as not to face each other directly.

The second compression stage 22 includes: a second impeller 22*a* (impeller) that imparts velocity energy to the refrigerant gas X4, which is compressed by the first compression stage 21 and supplied from the thrust direction, and discharges the gas to the radial direction; a second diffuser 22*b* (diffuser) that compresses the refrigerant gas X4 by converting the velocity energy imparted to the refrigerant gas X4 by the second impeller 22*a* to pressure energy, so as to discharge the resulting gas as the compressed refrigerant gas X1; a second scroll chamber 22*c* that guides the compressed refrigerant gas X1 discharged from the second diffuser 22*b* to the outside of the second compression stage 22; and an introduction scroll chamber 22*d* that guides the refrigerant gas X4 compressed by the first compression stage 21 to the second impeller 22*a*.

Note that some parts of the second diffuser 22*b*, second scroll chamber 22*c* and introduction scroll chamber 22*d* are formed by a second housing 22*e* that surrounds the second impeller 22*a*.

The second impeller 22*a* is fixed to the abovementioned rotating shaft 23 so as to be back to back with the first impeller 21*a*, and is rotated due to the rotation of the rotating shaft 23, which is imparted with the rotational power from the output shaft 11 of the motor 12 to rotate about the axis O.

The second diffuser 22*b* is disposed annularly in the periphery of the second impeller 22*a*. Additionally, in the turbo compressor 4 of the present embodiment, the second diffuser 22*b* is a vaneless diffuser with no diffuser vanes to reduce the tangential velocity of the refrigerant gas 4 in the second diffuser 22*b* and efficiently convert velocity energy to pressure energy.

The second scroll chamber 22*c* is connected with the passage R1 that is provided for supplying the compressed refrigerant gas X1 to the condenser 1, and supplies the compressed refrigerant gas X1 emitted from the second compression stage 22 to the passage R1.

It should be noted that the first scroll chamber 21*c* of the first compression stage 21 and the introduction scroll chamber 22*d* of the second compression stage 22 are connected through an external piping (not illustrated) provided independently from the first compression stage 21 and second compression stage 22, and the refrigerant gas X4 compressed by the first compression stage 21 is supplied to the second compression stage 22 via the external piping. The external piping is connected with the abovementioned passage R4 (refer to FIG. 1) so that a gas phase component X3 of the refrigerant which is generated in the economizer 2 is supplied to the second compression stage 22 via the external piping.

Also, the rotating shaft 23 is rotatably supported by a third bearing 24 and a fourth bearing 25, the third bearing 24 being fixed to the second housing 22*e* of the second compression stage 22 in a space 50 between the first compression stage 21 and second compression stage 22, and the fourth bearing 25 being fixed to the second housing 22*e* in the motor unit 10 side.

A gear unit 30 is provided for transmitting the rotational power of the output shaft 11 in the motor 12 to the rotating shaft 23, and is installed in a space 60 formed by a motor housing 13 of the motor unit 10 and the second housing 22*e* of the compressor unit 20.

The gear unit 30 is configured from a large diameter gear 31 fixed to the output shaft 11 in the motor 12 and a small diameter gear 32 fixed to the rotating shaft 23 while engaging with the large diameter gear 31, and transmits the rotational power of the output shaft 11 in the motor 12 to the rotating shaft 23 so that the number of revolutions of the rotating shaft 23 increase with respect to the number of revolutions of the output shaft 11.

Further, the turbo compressor 4 includes a lubricating oil supply equipment 70 which supplies the lubricating oil stored in the oil tank 40 to sliding portions, such as bearings (first bearing 14, second bearing 15, third bearing 24, and fourth bearing 25), the portions between the impellers (first impeller 21*a* and second impeller 22*a*) and housings (first housing 21*e* and second housing 22*e*), and the gear unit 30. It should be noted that only a portion of the lubricating oil supply equipment 70 is illustrated in the drawings.

In addition, the space 50 where the third bearing 24 is disposed and the space 60 where the gear unit 30 is installed are connected by a through hole 80 formed in the second housing 22*e*, and the space 60 is also connected with the oil tank 40. As a result, the lubricating oil supplied to the spaces 50 and 60 and then flown out from the sliding portions is recovered by the oil tank 40.

Next, the operation of the turbo compressor 4 according to the present embodiment configured in such a manner will be described.

First, lubricating oil is supplied from the oil tank 40 to the sliding portions of the turbo compressor 4 by the lubricating oil supply equipment 70, and then the motor 12 is driven. Then the rotational power of the output shaft 11 in the motor 12 is transmitted to the rotating shaft 23 via the gear unit 30, thereby rotating the first impeller 21*a* and second impeller 22*a* in the compressor unit 20.

When the first impeller 21*a* is rotated, the pressure at the suction port 21*d* of the first compression stage 21 becomes negative, as a result of which the refrigerant gas X4 from the passage R5 flows into the compression stage 21 via the suction port 21*d*.

The refrigerant gas X4 flown inside the first compression stage 21 is flown into the first impeller 21*a* from the thrust direction and then discharged to the radial direction due to the velocity energy imparted by the first impeller 21*a*.

The refrigerant gas X4 discharged from the first impeller 21*a* is compressed due to the conversion of the velocity energy thereof to the pressure energy by the first diffuser 21*b*. It should be noted here that in the turbo compressor 4 in the present embodiment, since the first diffuser 21*b* is a diffuser attached with the diffuser vanes 21*f*, the tangential velocity of the refrigerant gas 4 rapidly reduces by hitting the diffuser vanes 21, as a result of which the velocity energy is efficiently converted to the pressure energy.

The refrigerant gas X4 discharged from the first diffuser 21*b* is guided to the outside of the first compression stage 21 via the first scroll chamber 21*c*.

The refrigerant gas X4 guided to the outside of the first compression stage 21 is supplied to the second compression stage 22 via the external piping.

The refrigerant gas X4 supplied to the second compression stage 22 is flown into the second impeller 22*a* from the thrust direction via the introduction scroll chamber 22*d* and then discharged to the radial direction due to the velocity energy imparted by the second impeller 22*a*.

The refrigerant gas X4 discharged from the second impeller 22*a* is further compressed due to the conversion of the velocity energy thereof to the pressure energy by the second diffuser 22*b*, resulting in the production of compressed refrigerant gas X1.

The compressed refrigerant gas X1 discharged from the second diffuser 22*b* is guided to the outside of the second compression stage 22 via the second scroll chamber 22*c*.

The compressed refrigerant gas X1 guided to the outside of the second compression stage 22 is supplied to the condenser 1 via the passage R1.

According to the turbo compressor 4 in the present embodiment as described above, the suction port 21*d* located in the upstream side of the first impeller 21*a* communicates with the inside of the oil tank 40 via the gaps 21*j*, the intermediate space 21*h*, and the pressure equalizer 90, and thus the pressure at the suction port 21*d* and that of the inside of the oil tank 40 become equal. Therefore, when the first impeller 21*a* is rotated to make the pressure at the suction port 21*d* negative, the pressure inside the oil tank 40 also becomes negative.

For this reason, the lubricating oil supplied to the spaces 50 and 60 and then flown out therefrom flows towards the oil tank 40 with a negative pressure, as a result of which the lubricating oil can be readily recovered to the oil tank 40.

On the other hand, in the oil tank 40 where the pressure is negative, the gases which have been dissolved in the lubricating oil vaporize as the pressure reduces rapidly, resulting in the generation of oil foaming. Although the oil mist filling inside the oil tank 40 flows into the intermediate space 21*h* via the pressure equalizer 90 due to the oil foaming, since the intermediate space 21*h* and the suction port 21*d* are connected only through the slight gaps 21*j* therebetween, the oil mist can be retained in the intermediate space 21*h*.

Therefore, the oil mist does not leak out to the suction port 21*d* to contaminate the first impeller 21*a*, and thus the deterioration of compression properties due to the contamination by the oil mist in the first compression stage can be prevented. Furthermore, since the reduction of the amount of lubricating oil can be suppressed, it will be possible to continuously supply sufficient amount of lubricating oil to the sliding portions.

In addition, in the present embodiment, the intermediate space 21*h* has an annular shape having the axis O as its center, and the open end 90*a* of the pressure equalizer 90 in the intermediate space 21*h* is directed towards the tangential direction of the annular intermediate space 21*h*. As a result, the oil mist reaching the intermediate space 21*h* via the pressure equalizer 90 is discharged towards the tangential direction of the annular intermediate space 21*h*.

Accordingly, the swirling flow (as indicated by the arrows in FIG. 3) in line with the annular shape can be generated inside the intermediate space 21*h*. Therefore, the oil mist can be retained in the outer periphery of the intermediate space 21*h* due to the centrifugal force caused by the swirling flow, and thus it will be possible to reliably prevent the oil mist from leaking out to the suction port 21*d*.

Further, since the barrier plate 21*k* is provided within the intermediate space 21*h* between the gaps 21*j* and the open end 90*a* of the pressure equalizer 90, the oil mist is blocked by this barrier plate 21*k* and does not reach the gaps 21*j*, and thus the leakage of the oil mist to the suction port 21*d* can be prevented even more reliably.

Moreover, the drive section 21*i* of the inlet guide vanes 21*g* is accommodated within the intermediate space 21*h*, and the drive section 21*i* is driven in an atmosphere where the oil mist is present, and thus the longevity of the drive section 21*i* can be extended.

Note that the lubricating oil recovered by the present configuration and retained within the intermediate space 21*h* is returned to the inside of the oil tank 40 using an unillustrated pump or an auxiliary device such as an ejector.

Preferred embodiments of the turbo compressor and refrigerator according to the present invention have been described above with reference to the accompanying drawings. However, it goes without saying that the present invention is in no way limited to the abovementioned embodiments. Various shapes, combinations, and the like for the respective constituting elements described in the abovementioned embodiments are merely some examples thereof, and those skilled in the art will appreciate that various modifications, as based on the design requirements or the like, are possible without departing from the spirit and scope of the present invention.

For example, although the configuration provided with two compression stages (first compression stage 21 and second compression stage 22) has been described in the abovementioned embodiments, the present invention is not limited to this configuration, and it is also possible to adopt a configuration having three or more compression stages.

In addition, in the abovementioned embodiments, the turbo refrigerator has been described as one to be installed in buildings and factories to produce cooling water for air conditioning.

However, the present invention is not limited to those installed in buildings and factories to produce cooling water for air conditioning, but can also be applied to household and commercial refrigerators or freezers, or to domestic air conditioners.

Moreover, in the abovementioned first embodiment, a configuration has been described where the first impeller 21*a* provided to the first compression stage 21 and the second impeller 22*a* provided to the second compression stage 22 are disposed so as to be back to back.

However, the present invention is not limited to the above configuration, and it may also be configured so that the back surface of the first impeller 21*a* provided to the first compression stage 21 and the back surface of the second impeller 22*a* provided to the second compression stage 22 are facing the same direction.

Furthermore, in the abovementioned first embodiment, a turbo compressor has been described, which is provided with each of the motor unit 10, the compressor unit 20, and the gear unit 30.

However, the present invention is not limited to the turbo compressor with the above configuration, and it is also possible to adopt a configuration where a motor is disposed between the first compression stage and the second compression stage, for example.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A turbo compressor comprising:

multiple stages of compression devices arranged in series with respect to a gas passage, each of the compression devices comprising an impeller that rotates about an axis;

an oil tank capable of supplying lubricating oil to a sliding portion of the compression devices;

a partitioned intermediate space formed so as to communicate with the gas passage on an upstream side of the compression devices, gaps between the partitioned intermediate space and the gas passage, the gaps being configured to permit fluid communication between the intermediate space and the gas passage;

a pressure equalizer provided so as to continuously connect the partitioned intermediate space and the oil tank; and a barrier plate between the gaps, the pressure equalizer having an open end in the partitioned intermediate space, wherein the turbo compressor is configured to conduct a compression process sequentially by suctioning the gas in the gas passage.

2. The turbo compressor according to claim 1, wherein the partitioned intermediate space have an annular shape with the axis as its center, and an open end of the pressure equalizer in the partitioned intermediate space is directed towards a tangential direction of the annular shape of the partitioned intermediate space.

3. The turbo compressor according to claim 1, further comprising:

a flow rate adjusting unit which adjusts a suction amount of the compression devices in the gas passage on an upstream side of the compression devices; and a drive section of the flow rate adjusting unit accommodated within the partitioned intermediate space.

* * * * *